US006628059B2

(12) United States Patent
Rhee et al.

(10) Patent No.: US 6,628,059 B2
(45) Date of Patent: Sep. 30, 2003

(54) COLOR SELECTION APPARATUS FOR CATHODE RAY TUBE

(75) Inventors: Jong-Han Rhee, Suwon (KR); Soon-Cheol Shin, Suwon (KR); Hyang-Jin Koh, Suwon (KR); Sang-Ho Jeon, Seongnam (KR); Jun-Jong Lee, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/082,271

(22) Filed: Feb. 26, 2002

(65) Prior Publication Data

US 2002/0117957 A1 Aug. 29, 2002

(30) Foreign Application Priority Data

Feb. 27, 2001 (KR) ..... 2001-9898

(51) Int. Cl.[7] ..... H01J 29/80
(52) U.S. Cl. ..... 313/407; 313/402
(58) Field of Search ..... 313/407, 402, 313/403, 404

(56) References Cited

U.S. PATENT DOCUMENTS 4,110,760 A * 8/1978 van Nes ..... 396/547
4,926,089 A 5/1990 Moore ..... 313/403
4,942,332 A 7/1990 Adler et al. ..... 313/402
4,973,283 A 11/1990 Adler et al. ..... 445/30
4,973,879 A * 11/1990 Fujimura ..... 313/403
5,877,586 A * 3/1999 Aibara ..... 313/402
6,388,370 B1 * 5/2002 Ohmae ..... 313/403
6,437,496 B1 * 8/2002 Kim et al. ..... 313/402
2001/0004186 A1 * 6/2001 Song et al. ..... 313/407

* cited by examiner

*Primary Examiner*—Don Wong
*Assistant Examiner*—Thuy Vinh Tran
(74) *Attorney, Agent, or Firm*—Robert E. Bushnell, Esq.

(57) ABSTRACT

A color selection apparatus for a cathode ray tube includes a mask bearing a shape with short and long axes, and a frame combined with the mask. The mask is fitted to the frame while being tensioned either in the long axis direction or in the short axis direction. The mask has a plurality of strips spaced apart from each other by a predetermined distance, a plurality of real bridges disposed between the neighboring strips with a predetermined pitch while defining beam-guide holes, and one or more dummy bridges placed within each beam-guide hole while being extended from the strips in at least one direction. In any one reference column of m=0 and the other neighboring columns of m±n (n is a natural number), the real bridges arranged at the reference column are placed at lines different from the real bridges arranged at the columns of at least m±2 in the long axis direction.

16 Claims, 3 Drawing Sheets

COLOR SELECTION APPARATUS FOR CATHODE RAY TUBE

CLAIM OF PRIORITY

This application makes reference to, incorporates the same herein, and claims all benefits accruing under 35 U.S.C. §119 from an application entitled COLOR SELECTION APPARATUS FOR CATHODE RAY TUBE filed with the Korean Industrial Property Office on Feb. 27, 2001 and there duly assigned Serial No. 2001-9898.

BACKGROUND OF THE INVENTION

1. Technical Field

The present invention relates to a cathode ray tube, and more particularly, to a color selection apparatus for a cathode ray tube that has a large-sized flat panel.

2. Related Art

A cathode ray tube, the most popular display device, has been developed in various formats while keeping pace with the times. Recently, a wide screen cathode ray tube has been the choice of electronics consumers. In order to enlarge the screen size, the screen panel should be flat in consideration of qualities of the screen images displayed at the periphery of the screen.

As a design for a panel becomes enlarged and flattened, a shadow mask for the color selection apparatus is also enlarged in size. In consideration of various difficulties related to the enlargement of the curved shadow mask such as a weak strength thereof, a new-modeled color selection apparatus has now been employed for use in the cathode ray tube.

Such a color selection apparatus has a structure wherein a mask with a plurality of beam-guide holes is curved in only one direction while bearing a predetermined tension. Exemplars of recent efforts in the art include U.S. Pat. No. 4,926,089 to Moore, entitled TIED SLIT FOIL SHADOW MASK WITH FALSE TIES, issued on May 15, 1990, U.S. Pat. No. 4,942,332 to Adler et al., entitled TIED SLIT MASK FOR COLOR CATHODE RAY TUBES, issued on Jul. 17, 1990, and U.S. Pat. No. 4,973,283 to Adler et al., entitled METHOD OF MANUFACTURING A TIED SLIT MASK CRT, issued on Nov. 27, 1990.

A tension mask has a plurality of slits, with real ties interposed between neighboring slits. The mask is fitted to supporting members while being in a tensioned state. In operation, real ties are liable to be projected onto the screen while producing black lines thereon. The black lines diminish the picture quality of the screen. The real ties frequently cause the black lines on the screen to occur.

While these recent efforts provide advantages, I note that they fail to adequately provide an efficient and convenient color selection apparatus for a large-sized flat panel for a cathode ray tube.

SUMMARY OF THE INVENTION

It is an object of the present invention to provide a color selection apparatus for a cathode ray tube that minimizes occurrence of black lines due to real ties and that ensures good picture quality.

This and other objects may be achieved by a color selection apparatus for a cathode ray tube with the following features.

According to one aspect of the present invention, the color selection apparatus includes a mask bearing a shape with short and long axes, and a frame combined with the mask. The mask is fitted to the frame while being tensioned either in the long axis direction or in the short axis direction. The mask has a plurality of strips spaced apart from each other by a predetermined distance, a plurality of real bridges disposed between the neighboring strips with a predetermined pitch while defining beam-guide holes, and one or more dummy bridges placed within each beam-guide hole while being extended from the strips in at least one direction. In any one reference column of m=0 and the other neighboring columns of m±n (n is a natural number), the real bridges arranged at the reference column are placed at lines different from the real bridges arranged at the columns by at least m±2 in the long axis direction.

According to another aspect of the present invention, the color selection apparatus includes a tension mask having two sides with a first length and another two sides with a second length different from the first length, and a frame for maintaining the tensioned state of the tension mask in a constant manner. The tension mask has a plurality of slit-typed beam-guide holes for passing electron beams such that the electron beams land on a phosphor screen in a correct manner. Dummy bridges are provided within each beam-guide hole while forming a plurality of slits such that the plurality of slits communicate with each other via the dummy bridges. Real bridges define the beam-guide holes such that the beam-guide holes are arranged along each column in the vertical direction. The real bridges arranged at any one column are deviated in position from the real bridges arranged at the neighboring columns in an irregular manner.

To achieve these and other objects in accordance with the principles of the present invention, as embodied and broadly described, the present invention provides a color selection apparatus for a cathode ray tube, comprising: a mask having a length longer than a width, the length being measured in a first direction, the width being measured in a second direction perpendicular to the first direction; and a frame being combined with said mask, said mask being fitted to said frame and being tensioned in one direction selected from among the first and second directions; said mask forming a plurality of real bridges, beam-guide holes, dummy bridges, and strips, the beam-guide holes being formed in a plurality of columns parallel to one direction selected from among the first and second directions, the real bridges being located in the columns, the beam-guide holes being formed parallel to the strips, the strips being spaced apart from each other by a predetermined distance, the real bridges being disposed between adjacent ones of the strips, the real bridges defining the beam-guide holes, at least one of the dummy bridges extending from at least one of the strips into one of the beam-guide holes, the plurality of columns including a reference column and a second column adjacent to the reference column, the real bridges in the reference column being spaced apart from the real bridges in the second column as measured in a direction parallel to the columns.

To achieve these and other objects in accordance with the principles of the present invention, as embodied and broadly described, the present invention provides a color selection apparatus for a cathode ray tube, comprising: a tension mask having a first two sides with a first length, and a second two sides with a second length, the second length being different from the first length; and a frame for maintaining tensioned state of said tension mask in a constant manner; said tension mask having a plurality of slit-type beam-guide holes, dummy bridges, and real bridges, the beam-guide holes passing electron beams toward a phosphor screen, the dummy bridges extending into the beam-guide holes and forming a plurality of slits, the slits being in communication with each other across the dummy bridges, the beam-guide holes being formed in a plurality of columns parallel to a first direction, the real bridges being located in the columns, the real bridges in any one of the columns being displaced along the first direction from the real bridges in adjacent columns.

To achieve these and other objects in accordance with the principles of the present invention, as embodied and broadly described, the present invention provides an apparatus, comprising: a tension mask having a length and a width, the length being measured in a first direction, the width being measured in a second direction perpendicular to the first direction; and a frame being combined with said mask, said mask being fitted to said frame and being tensioned in at least one direction selected from among the first and second directions; said mask including a plurality of real bridges blocking electron beams, beam-guide holes being penetrated by electron beams conveyed to a phosphor screen, dummy bridges at least partially blocking electron beams, and strips blocking electron beams; the beam-guide holes being formed in a plurality of columns parallel to the first direction, the real bridges being located in the columns, the beam-guide holes being formed parallel to the strips, the strips being spaced apart from each other by a predetermined distance, the real bridges being disposed between adjacent ones of the strips, the real bridges defining the beam-guide holes, at least one of the dummy bridges extending from at least one of the strips into one of the beam-guide holes, the plurality of columns including a reference column, a second column, and a third column, the second column being adjacent to the reference column, the third column being adjacent to the second column and spaced apart from the reference column, the real bridges in the reference column being spaced apart from the real bridges in the second column by a first distance as measured in a direction parallel to the first direction, the real bridges in the reference column being spaced apart from the real bridges in the third column by a second distance as measured in a direction parallel to the first direction, the second distance being less than the first distance, each dummy bridge having a vertical width Dhw, each real bridge having a vertical width Rhw, Dhw being <=2 Rhw, and Dhw being >=0.5 Rhw.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE PREFERRED EMBODIMENTS

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being abroad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 4:
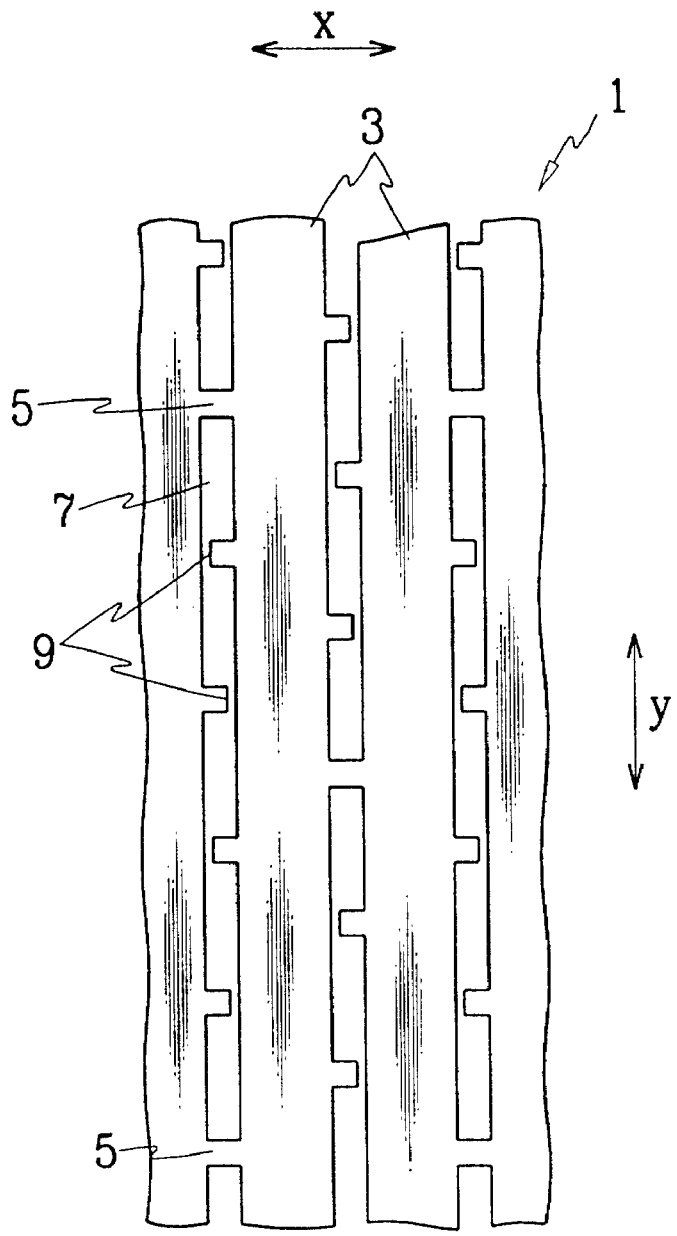
FIG. 4 illustrates a mask pattern for a color selection apparatus.

Turn now to FIG. 4, which illustrates a mask pattern for a color selection apparatus. A mask can have a plurality of slits, with real ties interposed between neighboring slits. The mask is fitted to supporting members while being in a tensioned state. Furthermore, in order to reduce visibility of the real ties, false ties differing from the real ties are provided between the neighboring slits. False ties are also known as dummy bridges.

Specifically, as shown in FIG. 4, the tension mask 1 has a plurality of strips 3 spaced apart from each other with a predetermined pitch, and real ties 5 arranged between the neighboring strips 3 that run in the direction of the column of the mask 1 (indicated by the Y arrow in the drawing) with a predetermined pitch while forming rectangular-shaped slits 7 between them.

False ties 9 are provided within each slit 7 while being extended from the strips 3 such that they do not interconnect the neighboring strips 3. In operation, the real ties 5 are liable to be projected onto the screen while producing black lines thereon.

Specifically, when the electron beams pass through the slits 7 of the mask 1, the electron beams are blocked against the real ties 5. Therefore, the real ties 5 are projected onto the screen. Such a projection is continuously made along the horizontal direction (the direction of the X arrow in the drawing) of the mask 1 so that black lines are formed at the screen in the horizontal direction.

The black lines diminish the picture quality of the screen. Therefore, the real ties 5 are positioned at the mask 1 in a controlled manner such that the black lines due to the real ties 5 should not be produced on the screen. Nevertheless, the real ties 5 are usually arranged with the same pattern on alternating columns so that the projections thereof are near to each other and frequently cause the black lines on the screen to occur.

Figure 1:
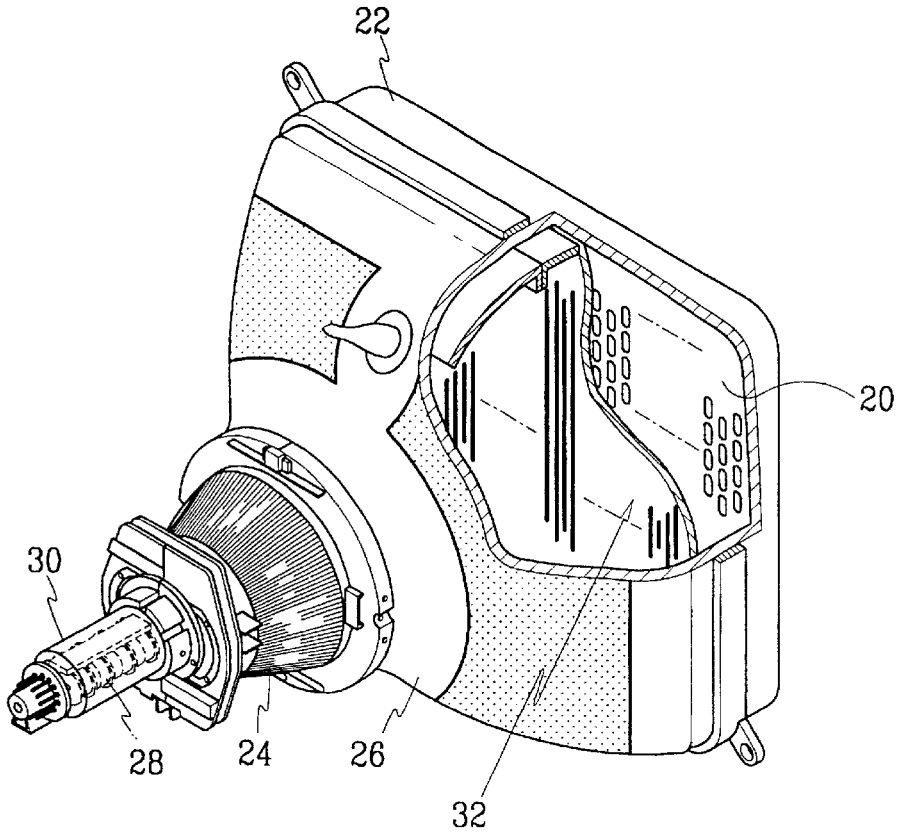
FIG. 1 is a partial sectional perspective view of a cathode ray tube with a color selection apparatus, according to the principles of the present invention.
Figure 2:
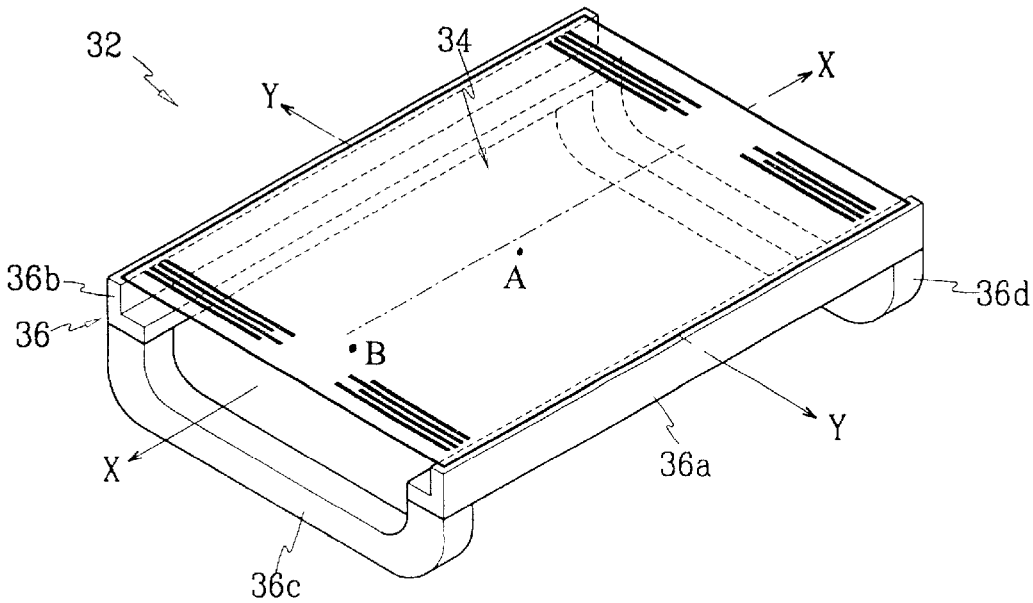
FIG. 2 is an amplified perspective view of the color selection apparatus shown in FIG. 1, according to the principles of the present invention.
Figure 3:
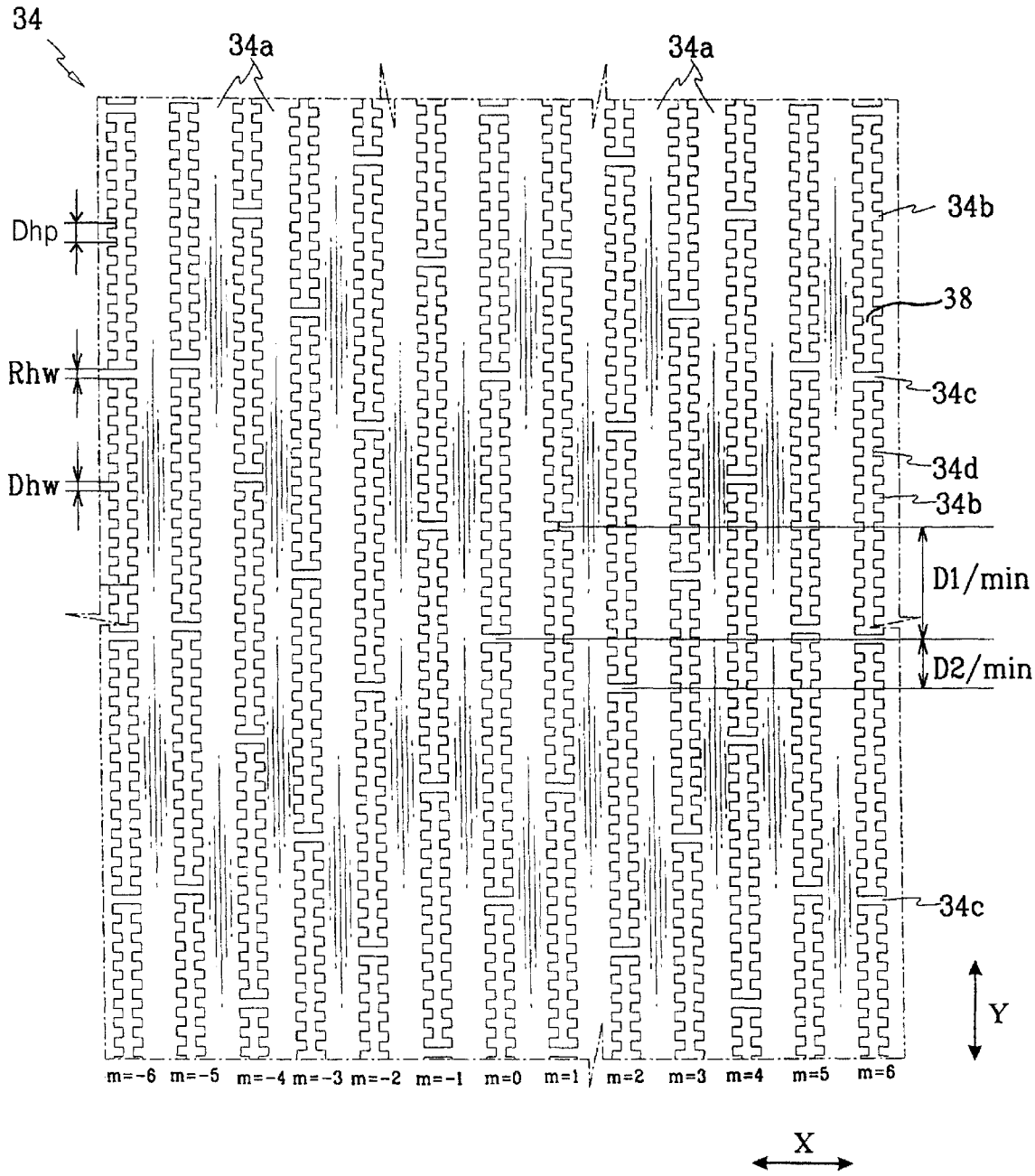
FIG. 3 illustrates a mask pattern for the color selection apparatus shown in FIG. 2, according to the principles of the present invention.

Preferred embodiments of this invention will be explained with reference to the accompanying FIGS. 1–3. The color selection apparatus includes a mask 34. Electron beams pass through the mask 34 while traveling toward a screen surface of a cathode ray tube. Images are formed at the screen surface. As shown in FIGS. 1–3, the strips are formed to block the electron beams, and to basically prevent the electron beams from passing through the color selection apparatus. A real bridge 34*c* is a region that blocks the electron beam, similar to the way the strip 34*a* blocks the electron beam. The real bridges 34*c* can be said to connect two adjacent strips 34*a*, as shown in FIG. 3, for example. The electron beam passes through a beam guide hole 34*b*.

A dummy bridge 34*d* is a region that at least partly blocks the electron beam, and includes a narrow slot or aperture that separates two adjacent strips 34*a*, as shown in FIG. 3, for example. The dummy bridge 34*d* almost connects two adjacent strips 34*a*. The dummy bridge 34*d* does not fully connect two adjacent strips 34*a* because of the narrow slot or aperture in the dummy bridge 34*d*.

Turn now to FIG. 1, which is a partial sectional perspective view of a cathode ray tube with a color selection apparatus, according to the principles of the present invention. As shown in FIG. 1, the cathode ray tube includes a panel 22 with an inner phosphor screen 20, a funnel 26 connected to the panel with an externally mounted deflection unit 24, and a neck 30 connected to the funnel 26 with an internally mounted electron gun 28. The electron gun 28 emits a plurality of red R, green G, and blue B electron beams to scan the phosphor screen 20.

The panel 22 has a flat outer surface, and a curved inner surface. A color selection apparatus is internally provided at the panel 22 to facilitate color selection with respect to the electron beams emitted from the electron gun 28.

Turn now to FIG. 2, which is an amplified perspective view of the color selection apparatus shown in FIG. 1, according to the principles of the present invention. FIG. 2 is an amplified perspective view of the color selection apparatus 32. The color selection apparatus 32 has a mask 34 bearing a rectangular shape with a long axis (indicated by the X—X line) and a short axis (indicated by the Y—Y line), and a frame 36 to which the mask 34 is fitted while being tensioned in the long axis X direction or in the short axis Y direction. The length of the mask 34 is measured in a first direction parallel to the X—X line. The width of the mask 34 is measured in a second direction parallel to the Y—Y line. When the mask 34 is rectangularly shaped, the length is longer than the width, as shown in FIG. 2.

In accordance with the principles of the present invention, a first embodiment sets forth that the mask 34 can be manufactured as shown in FIG. 3 with the columns (m=0, m=±1, m=±2, . . . ) formed in a direction parallel to the Y axis. Alternatively, in accordance with the principles of the present invention, a second embodiment sets forth that the mask 34 can be manufactured with the columns (m=0, m=±1, m=±2, . . . ) formed along the X axis. This second embodiment is not shown in the drawings explicitly. However, to view the second embodiment, the Y axis and the X axis shown in FIG. 3 would be reversed.

The X—X line shown in FIG. 2 is parallel to an X axis. The Y—Y line shown in FIG. 2 is parallel to a Y axis and is perpendicular to the X—X line.

The frame 36 is formed with a pair of supporting members 36*a* and 36*b* and a pair of elastic members 36*c* and 36*d*, but it is not limited thereto. The supporting members 36*a* and 36*b* are arranged in parallel while being spaced apart from each other by a predetermined distance. In this state, the elastic members 36*c* and 36*d* are respectively welded to the bottom of opposite ends of the supporting members 36*a* and 36*b*. The mask 34, tensioned in the short axis Y direction, is fixed onto the top surface of the supporting members 36*a* and 36*b* to thereby form a mask assembly. The mask 34 is formed of an iron-based thin plate, and is fitted to the frame 36 while being tensioned in the short axis Y direction.

Turn now to FIG. 3, which illustrates a mask pattern for the color selection apparatus shown in FIG. 2, according to the principles of the present invention. As shown in FIG. 3, the mask 34 has a plurality of strips 34*a*, and a plurality of beam-guide holes 34*b* provided between the neighboring strips 34*a* with predetermined vertical and horizontal pitches.

The strips 34*a* are arranged along the short axis Y direction (the column direction). Real bridges 34*c* are provided between the neighboring beam-guide holes 34*b* in the short axis Y direction while interconnecting the neighboring strips 34*a*. That is, the plurality of beam-guide holes 34*b* are arranged between the neighboring strips 34*a* in the short axis Y direction while interposing the real bridges 34*c*. Dummy bridges 34*d* are arranged within each beam-guide hole 34*b* while being extended from the strips 34*a* in the long axis X direction.

The number of dummy bridges 34*d* formed at one of the neighboring strips 34*a* within the beam-guide hole 34*b* is established to be an odd value while facing the same number of dummy bridges 34*d* formed at the other strip 34*a*. The odd values can be 11, 13, or 15, for example. Of course, the arrangement of the dummy bridges 34*d* may be varied in an appropriate manner.

Accordingly, the beam-guide hole 34*b* has a structure wherein a plurality of inner slits 38 communicate with each other across the dummy bridges 34*d* (or via the dummy bridges 34*d*). This bridge structure may be varied in an appropriate manner.

The vertical width Rhw of the real bridges 34*c* arranged at each column may be the same or differentiated. Furthermore, the vertical width Rhw of the real bridge 34*c* and the vertical width Dhw of the dummy bridge 34*d* may be the same, or the vertical width Dhw of the dummy bridge 34*d* may be established to be larger or smaller than the vertical width Rhw of the real bridge 34*c*.

In order to reduce the possible black lines through controlling the volume ratio of the real bridge to the dummy bridge, the vertical width Rhw of the real bridge 34*c* and the vertical width Dhw of the dummy bridge 34*d* are established to satisfy the following condition: 0.5 Rhw<=Dhw<=2.0 Rhw. Thus, throughout the mask 34, Dhw is greater than or equal to 0.5Rhw, and Dhw is less than or equal to 2.0 Rhw.

In the center area "A" of the mask 34, the vertical width Rhw of the real bridge 34*c* and the vertical width Dhw of the dummy bridge 34*d* are established to satisfy the following condition: 1.2 Rhw<=Dhw<=2.0 Rhw. Thus, in the center area of the mask 34, Dhw is greater than or equal to 1.2 Rhw, and Dhw is less than or equal to 2.0 Rhw. In the center area "A" the Rhw can be referred to as Rhw_c, and the Dhw can be referred to as Dhw_c.

In the side peripheral area "B" of the mask 34, the vertical width Rhw of the real bridge 34*c* and the vertical width Dhw of the dummy bridge 34*d* are established to satisfy the following condition: 0.8 Rhw<=Dhw<=2.0 Rhw. Thus, in the side peripheral area of the mask 34, Dhw is greater than or equal to 0.8 Rhw, and Dhw is less than or equal to 2.0 Rhw. In the side area "B" the Rhw can be referred to as Rhw_s, and the Dhw can be referred to as Dhw_s.

The vertical pitch Dhp of a dummy bridge 34*d* is shown in FIG. 3. FIG. 3 shows that all dummy bridges have the same vertical pitch. However, the vertical pitch of the dummy bridges is not limited to this, and it is possible for different dummy bridges to have different vertical pitches, in accordance with the principles of the present invention.

In any one reference column of m=0, the real bridges 34*c* are arranged along the column while interposing the odd numbered dummy bridges 34*d*. That is, one of the real bridges 34*c* is followed by a sequence of the odd-numbered dummy bridges 34*c* that is in turn followed by another real bridge 34*c*. The reference column of m=0 illustrated in FIG. 3 shows 13 dummy bridges 34*d*, a real bridge 34*c* following those 13 dummy bridges 34*d*, with the real bridge 34*c* followed by 13 more dummy bridges 34*d*, for example.

Furthermore, in the reference column of m=0 and other neighboring columns of m=±n, the real bridges 34*c* arranged at the reference column are not placed at the same line as the real bridges 34*c* arranged at the other columns for at least m±2 in the long axis X direction. That is, the real bridges 34*c* arranged at any one column are deviated in position from those arranged at the neighboring columns. The number n is an integer other than zero.

Specifically, the real bridges 34*c* at the reference column (m=0) and those at the 6th columns from the reference column (m=6, m=−6, m=12, m=−12, . . . ) in the long axis direction (X axis) have the same pattern. The real bridges 34*c* at the intermediate columns (for instance, m=1, . . . , m=5) have irregular patterns that are different from the reference column and are different from the 6th columns from the reference column.

With reference to FIG. 3, the m=1 column is next to the m=0 column. The m=1 column is adjacent to the m=0 column. The m=1 column is the neighboring column to the m=0 column. The m=2 column is not next to the m=0 column. The m=2 column is not the column adjacent to the m=0 column. The m=2 column is spaced apart from the m=0 column by a distance corresponding to one column. The m=0 column can be referred to as the first column. The m=1 column can be referred to as the second column. The m=2 column can be referred to as the third column.

In the above structure, the projections of the real bridges 34*c* onto the screen are not made in a continuous manner so that the viewer does not recognize such projections as lines on the display screen.

Furthermore, it is preferable that the following conditions should be satisfied in the formation of such irregular bridge patterns. The minimum distance (D1/min) is the minimum distance between one real bridge 34*c* in the reference column (m=0) and the real bridge 34*c* in a neighboring columns (m=+1 or m=−1) closest to the real bridge 34*c* in the reference column, as measured along a direction parallel to the Y axis.

The minimum distance (D1/min) between one real bridge 34*c* in the reference column (m=0) and one real bridge 34*c* in a neighboring column (m=+1 or m=−1) while firstly meeting the former real bridge should be established to be more than 2.5 times of the vertical pitch of the dummy bridges in the reference column (m=0) and the m±1 columns.

Furthermore, in another case, the minimum distance (D2/min) is the minimum distance between one real bridge 34*c* in the reference column (m=0) and the real bridge 34*c* in the m±2 columns closest to the real bridge 34*c* in the reference column, as measured along a direction parallel to the Y axis.

The minimal distance (D2/min) between any one real bridge placed at the reference column (m=0) and the real bridge placed at the (m±2) columns while firstly meeting the former real bridge should be established to be more than 1.5 times of the vertical pitch of the dummy bridges arranged at the reference column (m=0) and the m±2 columns.

In the preferred embodiment of the present invention, the patterns of the m±1, m±2, m±3, m±4, and m±5 columns are symmetrically identical, as shown in FIG. 3. However, the patterns of those columns are not limited to that configuration in the present invention. The principles of the present invention do not require the patterns of those columns to be symmetrically identical.

In the preferred embodiment of the present invention, the pattern of the m=+2 column is identical to the pattern of the m=+8 column. However, the principles of the present invention do not require the patterns of those columns to be identical.

The objective of the present invention is to provide a color selection apparatus for a cathode ray tube that minimizes occurrence of black lines because of the real bridges and that ensures good picture quality. To accomplish this objective, the color selection apparatus includes a tension mask that has real bridges which define beam-guide holes such that the beam-guide holes are arranged along each column in the vertical direction, wherein the real bridges arranged at any one column are deviated in position from the real bridges arranged at the neighboring columns in an irregular manner. Furthermore, under the above constitution, it is preferable that the real bridges satisfy the above conditions of D1/min or D2/min in the formation of the irregular bridge patterns, as described above. Substantially, the inventors of the present invention knew that if D1/min is more than 2.5 times of the vertical pitch of the dummy bridges and D2/min is more than 1.5 times of the vertical pitch of the dummy bridges, a viewer cannot perceive the existence of the black lines because of the real bridges occurring on the screen of the cathode ray tube, through a plurality of tests. In at least one of the tests, the vertical pitch of the dummy bridges was 0.59 mm, the number of the dummy bridges were 5–9, and the inventors confirmed the shape of the dummy bridges shadowed on a panel of the cathode ray tube from a position which is 1 meter from the panel. That is, the inventors could not perceive the black lines due to an optical illusion phenomenon under the conditions of D1/min or D2/min.

As described above, in the inventive color selection apparatus for a cathode ray tube, the bridge patterns of the mask for defining the beam-guide holes are made such that the projections of bridges cannot induce occurrence of black lines on the screen. In this way, a screen image is clearly made without the appearance of black lines. The screen image has an improved clarity due to the present invention.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A color selection apparatus for a cathode ray tube, comprising:

a mask having a length longer than a width, the length being measured in a first direction, the width being measured in a second direction perpendicular to the first direction; and a frame being combined with said mask, said mask being fitted to said frame and being tensioned in one direction selected from among the first and second directions;

said mask forming a plurality of real bridges, beam-guide holes, dummy bridges, and strips, the beam-guide holes being formed in a plurality of columns parallel to one direction selected from among the first and second directions, the real bridges being located in the plurality of columns, the beam-guide holes being formed parallel to the strips, the strips being spaced apart from each other by a predetermined distance, the real bridges being disposed between adjacent ones of the strips, the real bridges defining the beam-guide holes, at least one of the dummy bridges extending from at least one of the strips into one of the beam-guide holes, the plurality of columns including a reference column and a second column adjacent to the reference column, the real bridges in the reference column being spaced apart from the real bridges in the second column as measured in a direction parallel to the plurality of columns, the plurality of columns including a third column next to the second column and spaced apart from the reference column, the real bridges in the reference column being spaced apart from the real bridges in the third column as measured in a direction parallel to the plurality of columns.

2. The apparatus of claim 1, a total number of the dummy bridges extending from one of the strips into one of the beam-guide holes being an odd number.

3. The apparatus of claim 1, the real bridges in same column being formed with same vertical width.

4. The apparatus of claim 1, the real bridges in same column being formed with variable vertical widths.

5. The apparatus of claim 1, the real bridges and the dummy bridges in same column being formed with same vertical width.

6. The apparatus of claim 1, the dummy bridges in same column being formed with variable vertical widths, each of the variable vertical widths being one selected from among larger and smaller than vertical width of the real bridges.

7. The apparatus of claim 1, the dummy bridges in same column being formed with variable vertical widths, each of the variable vertical widths being one selected from among larger and smaller than vertical width of the real bridges in the same column as the dummy bridges.

8. The apparatus of claim 1, each respective one of the real bridges in the reference column being spaced apart from a respective one of the real bridges in the second column by a first distance as measured in the direction parallel to the columns, the first distance being more than 2.5 times of a vertical pitch of one of the dummy bridges in the reference column.

9. The apparatus of claim 1,each respective one of the real bridges in the reference column being spaced apart from a respective one of the real bridges in the third column by a predetermined distance as measured in the direction parallel to the columns, the predetermined distance being more than 1.5 times of a vertical pitch of one of the dummy bridges in the reference column.

10. A color selection apparatus for a cathode ray tube, comprising:

a mask having a length longer than a width, the length being measured in a first direction, the width being measured in a second direction perpendicular to the first direction; and a frame being combined with said mask, said mask being fitted to said frame and being tensioned in one direction selected from among the first and second directions;

said mask forming a plurality of real bridges, beam-guide holes, dummy bridges, and strips, the beam-guide holes being formed in a plurality of columns parallel to one direction selected from among the first and second directions, the real bridges being located in the plurality of columns, the beam-guide holes being formed parallel to the strips, the strips being spaced apart from each other by a predetermined distance, the real bridges being disposed between adjacent ones of the strips, the real bridges defining the beam-guide holes, at least one of the dummy bridges extending from at least one of the strips into one of the beam-guide holes, the plurality of columns including a reference column and a second column adjacent to the reference column, the real bridges in the reference column being spaced apart from the real bridges in the second column as measured in a direction parallel to the plurality of columns, each one of the real bridges in the reference column being spaced apart from each one of the real bridges in the second column by at least a first distance as measured in the direction parallel to the plurality of columns, each one of the real bridges in the reference column being spaced apart from each one of the real bridges in the third column by at least a second distance as measured in the direction parallel to the plurality of columns, the second distance being greater than zero.

11. The apparatus of claim 10, the first distance being larger than the second distance.

12. The apparatus of claim 10, the first distance being more than 2.5 times of a vertical pitch of one of the dummy bridges.

13. The apparatus of claim 10, the second distance being more than 1.5 times of a vertical pitch of one of the dummy bridges.

14. A color selection apparatus for a cathode ray tube, comprising:

a mask having a length longer than a width, the length being measured in a first direction, the width being measured in a second direction perpendicular to the first direction; and a frame being combined with said mask, said mask being fitted to said frame and being tensioned in one direction selected from among the first and second directions;

said mask forming a plurality of real bridges, beam-guide holes, dummy bridges, and strips, the beam-guide holes being formed in a plurality of columns parallel to one direction selected from among the first and second directions, the real bridges being located in the plurality of columns, the beam-guide holes being formed parallel to the strips. the strips being spaced apart from each other by a predetermined distance, the real bridges being disposed between adjacent ones of the strips, the real bridges defining the beam-guide holes, at least one of the dummy bridges extending from at least one of the strips into one of the beam-guide holes, the plurality of columns including a reference column and a second column adjacent to the reference column, the real bridges in the reference column being spaced apart from the real bridges in the second column as measured in a direction parallel to the plurality of columns, each dummy bridge having a vertical width Dhw, each real bridge having a vertical width Rhw, Dhw being $\leqq 2$ Rhw, and Dhw being $\geqq 0.5$ Rhw.

15. The apparatus of claim 14, each respective one of the real bridges in the reference column being spaced apart from a respective one of the real bridges in the second column by a first distance as measured in the direction parallel to the plurality of columns, the first distance being more than 2.5 times of a vertical pitch of one of the dummy bridges in the reference column.

16. The apparatus of claim 14, with the plurality of columns including a third column next to the second column and spaced apart from the reference column, each respective one of the real bridges in the reference column being spaced apart from a respective one of the real bridges in the third column by a predetermined distance as measured in the direction parallel to the plurality of columns, the predetermined distance being more than 1.5 times of a vertical pitch of at least one of the dummy bridges in the reference column.

* * * * *